US006422613B1

(12) United States Patent
Boroviak

(10) Patent No.: US 6,422,613 B1
(45) Date of Patent: Jul. 23, 2002

(54) GATE LATCH

(76) Inventor: Richard Boroviak, 219 Weybourne Road, Oakville, Ontario (CA), L6K 2T7

( * ) Notice: Subject to any disclaimer, the term of this patent is extended or adjusted under 35 U.S.C. 154(b) by 0 days.

(21) Appl. No.: 09/500,020

(22) Filed: Feb. 8, 2000

(30) Foreign Application Priority Data

Jan. 26, 2000 (CA) ..... 2296994

(51) Int. Cl.[7] ..... E05C 19/10

(52) U.S. Cl. ..... 292/100; 292/2; 292/80; 292/95; 292/96; 292/107; 292/116; 292/128; 292/340; 292/DIG. 19; 256/73

(58) Field of Search ..... 292/100, 95, 96, 292/80, 128, 2, 107, 340, DIG. 19, 116; 256/73

(56) References Cited

U.S. PATENT DOCUMENTS

| | | | | | |
|---|---|---|---|---|---|
| 41,064 | A | * | 1/1864 | Frick | 292/128 |
| 126,445 | A | * | 5/1872 | Clough | 292/128 |
| 156,478 | A | * | 11/1874 | Breidenbach | 292/128 |
| 341,402 | A | * | 5/1886 | Bradley | 292/116 |
| 415,355 | A | * | 11/1889 | Atteberry | 292/116 |
| 507,618 | A | * | 10/1893 | Hoffmeier | 292/128 |
| 618,091 | A | * | 1/1899 | Hegel | 292/128 |
| 965,993 | A | * | 8/1910 | Dey | 278/51 |
| 978,658 | A | * | 12/1910 | Schnell | 292/128 |
| 1,053,717 | A | * | 2/1913 | Derryberry | 292/95 |
| 1,339,781 | A | * | 5/1920 | Nellis | 292/128 |
| 1,566,668 | A | * | 12/1925 | Glass | 224/42.26 |
| 2,093,182 | A | * | 9/1937 | Anderson | 292/128 |
| 2,590,423 | A | * | 3/1952 | Laurin et al. | 292/80 |
| 3,210,776 | A | * | 10/1965 | Cox | 4/633 |

FOREIGN PATENT DOCUMENTS

| | | | | |
|---|---|---|---|---|
| GB | 0283736 | * | 1/1928 | 292/96 |

* cited by examiner

*Primary Examiner*—J. J. Swann
*Assistant Examiner*—Carlos Lugo

(57) ABSTRACT

The present invention relates to a gate latch comprising an integrated latch/handle assembly, a mounting bracket, a return spring and a flat head shoulder bolt. The integrated latch/handle assembly is a flat bar section comprised of various radiused and right angled bends allowing the assembly to wrap around the leading edge of the fence gate with one of the bends forming the actual latch bolt. The ends of the assembly are bent to form handles which operate the mechanism, the handles having radiused ends. The mounting bracket is a flat steel bar section with two holes provided for attaching the bracket to the gate. The return spring is held in place by the shoulder bolt which attaches the handle assembly, mounting bracket and spring firmly together.

10 Claims, 6 Drawing Sheets

GATE LATCH

BACKGROUND OF THE INVENTION

1. Field of the Invention

This invention relates to latching mechanisms and, more particularly to mechanical metal latches used to secure wooden fence gates.

2. Description of the Prior Art

Gate latches provide a simple method for securing fence gates from unwanted opening while allowing the gate to be opened, closed and locked at will with a minimum amount of effort.

The most popular style of latch is referred to as a gravity latch in that it is the force of gravity that pulls the latch plate down on a protruding striker bar. This type of latch generally is operable from one side of the gate only.

Another very popular design is referred to as the thumb latch. This design has a release lever that protrudes through the fence gate and operates a flat bar style of bolt which is secured to the fence post by a metal catch bracket. This type of latch is operable from both sides of the gate enabling the user to open and secure the gate from either side. Installation of this type requires holes to be bored through the gate while the latching plate normally requires a mortise to be cut into the securing member. This type of mechanism would require the installer to have a variety of tools, either hand or power and a minimum skill level to carry out the various woodworking procedures.

There are generally two types of barrel-bolt gate-latches available; a sliding mechanical bolt that requires a person to slide it shut and a spring assisted bolt which will close on it's own as the gate is closed. While these designs are fairly simple to install, with a minimum amount of tools or skill required, these designs can only be operated from one side of the gate. These designs are very unforgiving of any movement involving the gate support and/or the striker side support in that the mechanism will not close and latch if any of the pieces become misaligned as is the case where support posts heave due to frost action.

SUMMARY OF THE INVENTION

It is the object of the present invention to simplify the installation process of the gate latch. This installation will normally be carried out using only a screwdriver and does not requiring any woodworking procedures such as drilling, mortising, countersinking, cutting or chiseling.

It is a further object of the present invention to provide a mechanism that can be operated from both sides of the gate while at the same time having a self latching ability if the gate were to be pushed or slammed shut or closed by an automatic closing device. This gate latching mechanism is tolerant to movement of the fencing components while maintaining the ability to secure the fence gate throughout such movements as heaving of the fence posts due to freeze—thaw actions, misalignment due to wear and tear on the components and sagging of the fence materials.

Thus, in accordance with the present invention, there is provided a metal gate latch comprising an integrated latch/handle assembly, a mounting bracket, a return spring and a flat head shoulder bolt. The integrated latch/handle assembly is a flat bar section comprised of various radiused and right angled bends allowing the assembly to wrap around the leading edge of the fence gate with one of the bends forming the actual latch bolt. The ends of the assembly are bent to form handles which operate the mechanism, said handles having radiused ends. The mounting bracket is a flat steel bar section with two holes provided for attaching the bracket to the gate. The return spring is held in place by the shoulder bolt which attaches the handle assembly, mounting bracket and spring firmly together.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
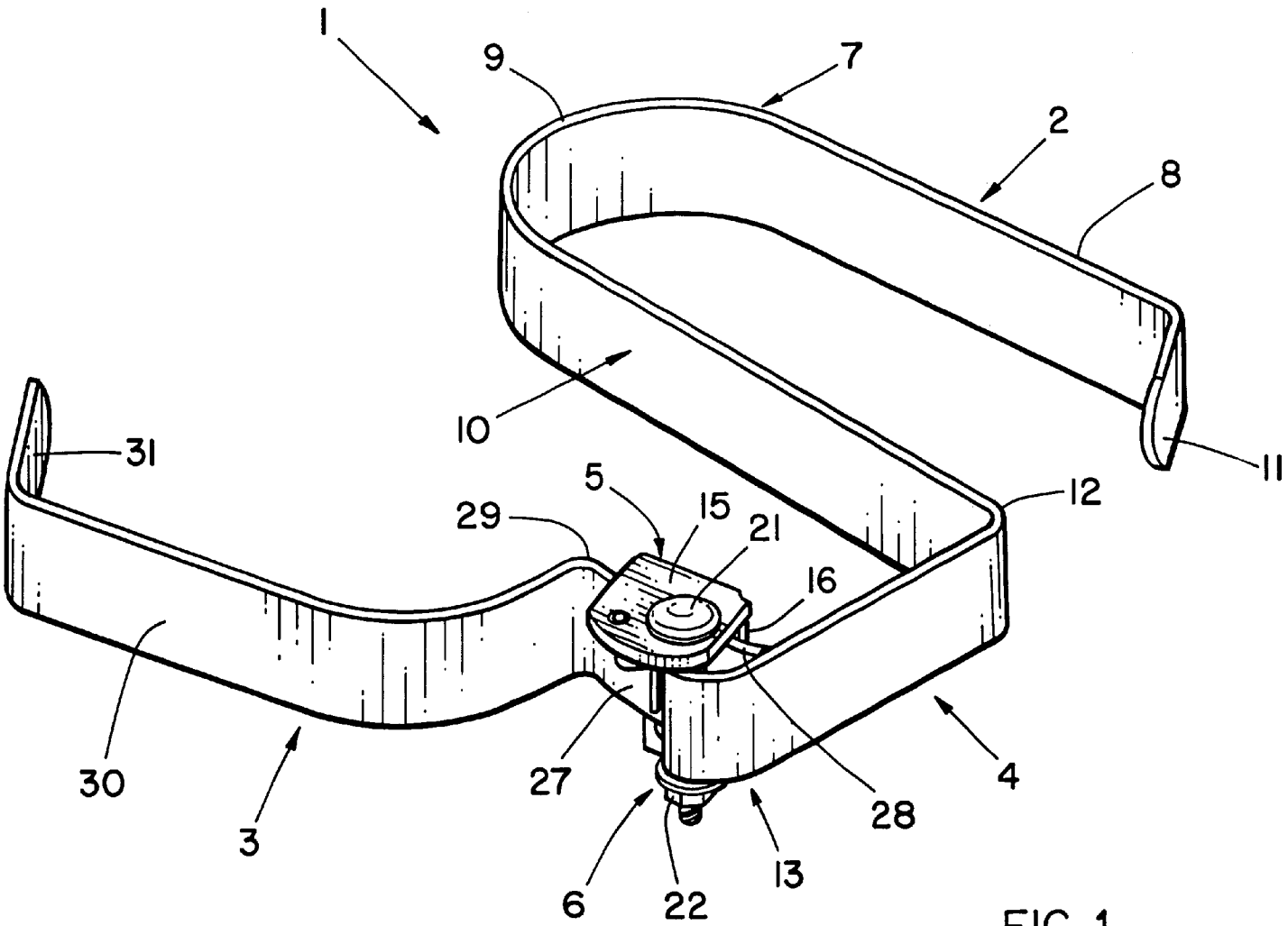
FIG. 1 is a perspective view of a gate latch according to the present invention .
Figure 2:
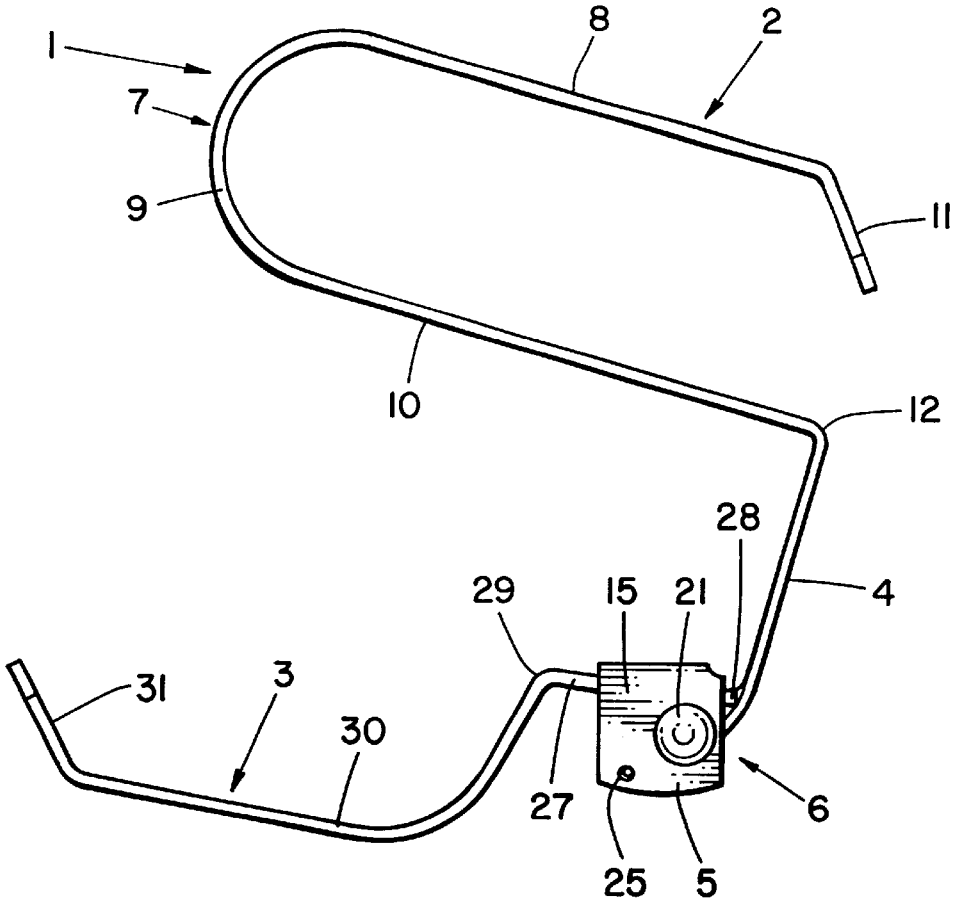
FIG. 2 is a top plan view of the gate latch of FIG. 1.
Figure 3:
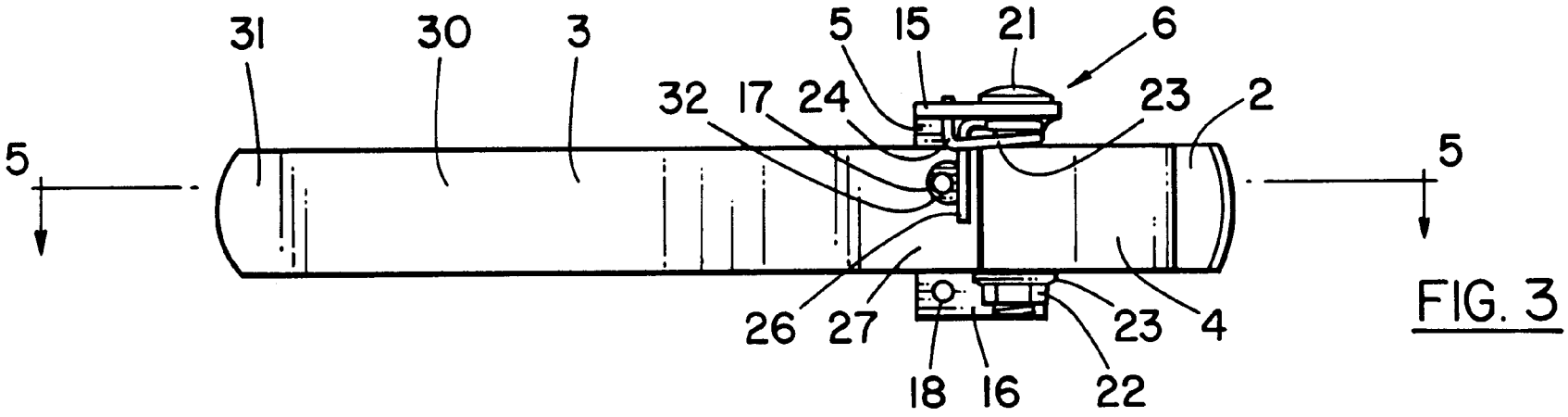
FIG. 3 is a back plan view of the gate latch of FIG. 2.
Figure 4:
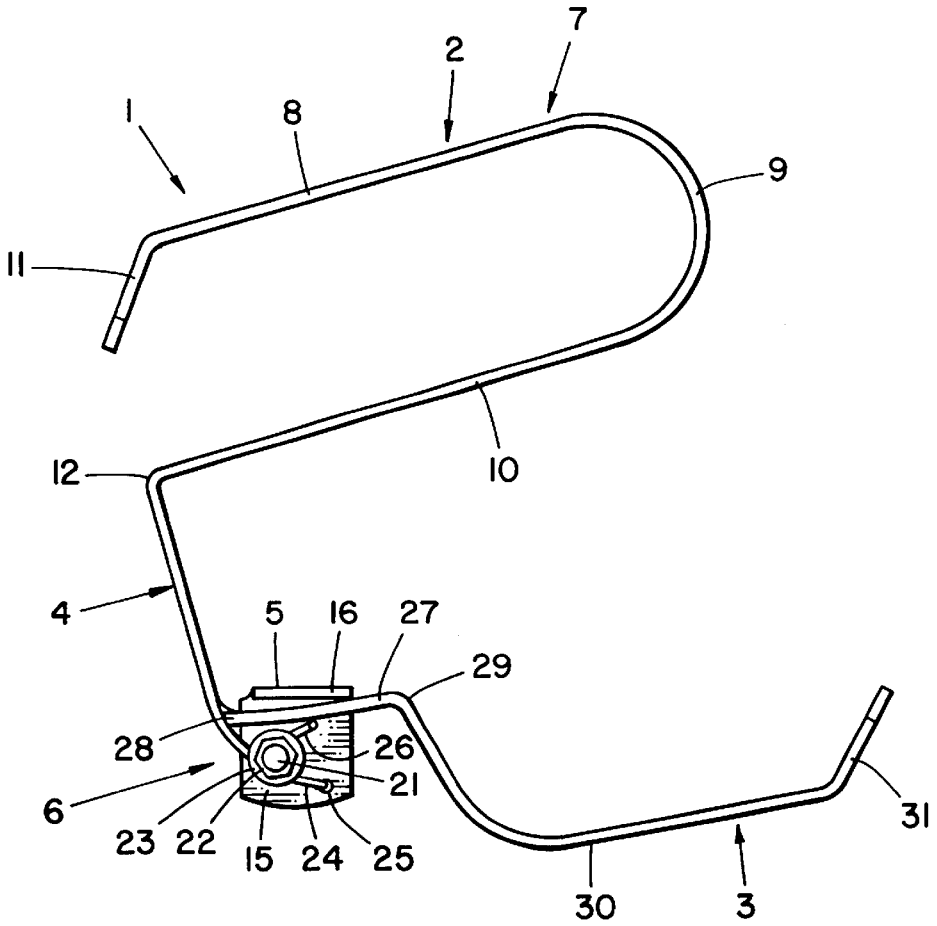
FIG. 4 is a bottom plan view of the gate latch of FIG. 1.
Figure 5:
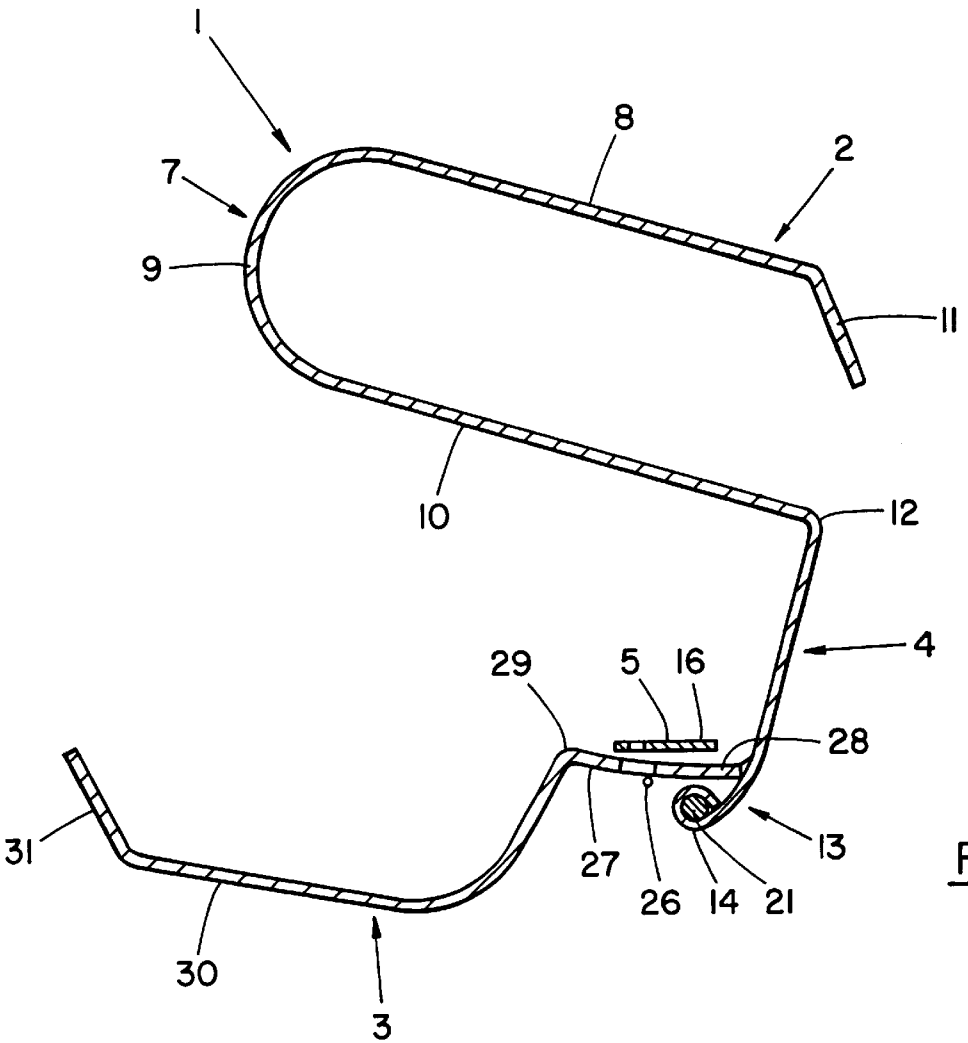
FIG. 5 is a cross section of the gate latch of FIG. 3 at line 5—5.

Referring to FIGS. 1 to 6, a gate latch according to the present invention is generally indicated at 1. The gate latch 1 includes a first handle portion, generally indicated at 2, a second handle portion indicated at 3, a latch portion 4, mounting bracket 5 and means 6 to pivotally connect the latch portion 4 to bracket 5. In the preferred embodiment illustrated, the first handle portion 2, is a generally U-shaped flat bar member 7 having an outer section 8, an interconnecting curved section 9 and an inner section 10. The free end 11 of the outer section 8 is bent inwards with the corners of the bar 7 rounded to prevent injury.

The latch portion 4 of said gate latch extends generally perpendicular and co-planar from the end 12 of said inner section 10. The latch section 4 is also preferably formed of a flat bar member and as shown in the Figs. is preferably formed from the same flat bar member as the first handle portion 2. The free end 13 of said latch portion 4 is adapted for pivotal connection to bracket 5. In the preferred embodiment shown in the Figs. free end 13 is formed into loop 14.

The bracket 5 has a generally inverted L-shaped configuration with a top flat section 15 and a vertically depending plate section 16. Mounting holes 17, 18 are provided in said plate section 16 for attaching the bracket to a wooden gate 19 (see FIG. 6) with screws or other conventional fastening members (not shown). In order to pivotal connect the latch portion 4 to bracket 5 a bolt hole 20 is provided in the top flat section 15 of bracket 5. A shoulder bolt 21 is placed through the bolt hole 20 and the loop 14 on the free end of latch portion 4. Nut 22 and washer 23 retain the latch portion 4 in place. A spring 23 (best illustrated in FIG. 3) is also placed on the shoulder bolt 21. One end 24 of spring 23 is placed in hole 25 provided in the top section 15 of bracket 5. The spring 23 encircles bolt 21 with its second end 26 biasing the gate latch 1 into the latched position as described below.

The second handle portion 3 in the preferred embodiment illustrated in the Figs. is also formed from a flat metal bar bent to the desired configuration. The second handle portion 3 has a first section 27 with its first end 28 connected to the latch portion 4 adjacent said loop 14. In the embodiment illustrated the first end 28 of first section 27 of second handle portion 3 is welded to the latch portion 4. At the second end 29 of said first section 27 the flat metal bar is bent outwardly to form a handle section 30. The free end 31 of said handle section 30 is bent inwardly and the corners rounded to prevent any sharp edges protruding. A hole 32 is provided in said first section 27 opposite the top hole 17 in the plate section 16 of bracket 5 to permit the mounting screw to be inserted. The first section 27 is preferably dimensioned so that the bottom hole 18 in the plate section 16 of bracket 5 is accessible.

Figure 6:
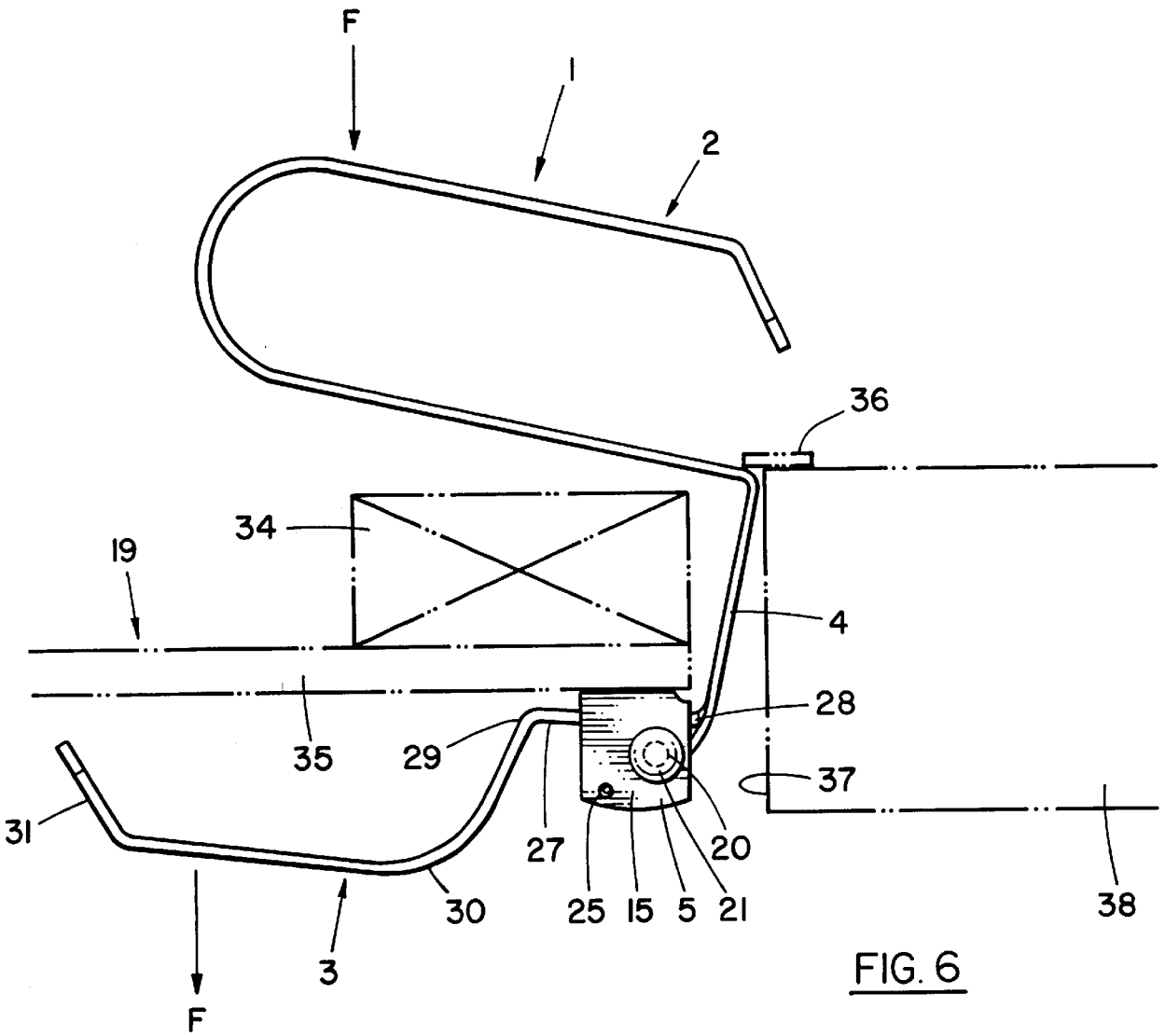
FIG. 6 is a top plan view of the gate latch of FIG. 1 installed on a wooden gate.

As illustrated in FIG. 6 the gate latch 1 of the present invention is sized to wrap around the edge 33 of a wooden gate generally indicated at 19. The gate 19 typically has a vertical side rail 34 formed from 2"×4" lumber and fence boards 35 of 1"×6" boards. A latch plate 36 (either metal or wood) extends over the edge 37 of the fence post 38. The gate 19 is hinged to open in one direction, in-swinging or out-swinging. In the embodiment shown in FIG. 6, assuming the fence boards 35 are mounted on the outside of gate 19, the gate 19 is left hinge mounted to open in-swinging. The end 12 of the inner section 10 of the first handle portion 2 and the latch portion 4 when biased in the closed position are prevented by latch plate 36 from allowing the gate to open. The gate is opened by either pulling on the second handle section 3 or pushing on first handle portion 2. The force F (FIG. 6) causes the gate latch 1 to pivot on shoulder bolt 21 thereby moving the end 12 of the inner section 10 of the first handle portion 2 and the latch portion 4 clear of latch plate 36 permitting the gate to swing open.

The gate latch of the present invention is preferably manufactured by welding the components together.

The gate latch of the present invention because of its unique construction provides numerous advantages over conventional gate latches. The design of the present latch eliminates dangerous metal parts projecting past the gate or fence post, as is the norm for most gate latch hardware.

The latch of the present invention replicates the action of a traditional type doorknob set without the required machining of wood such as boring holes through the gate, mortising for mounting plates or striker plates. This means the gate may be closed and latched simply by pushing the gate shut, either by hand force or by mechanical automatic closing devices.

Because of its unique design the latch of the present invention does not require any specialized skills for installation; the entire assembly is attached using only a screwdriver.

The latch of the present invention incorporates integral handles comprising a complete kit without the need to purchase additional parts and allows the gate to be opened from either side while providing a positive latching action to keep the gate closed. As well the one design accommodates every type of gate attachment such as left hand hinge, right hand hinge, in-swinging gate or out-swinging gate without any modification of the mechanism required. For example to mount on an out-swinging gate latch plate 36 would be moved the opposite side of post 38 and the bracket 5 inverted and mounted on the inside of side rail 34. Because of its design the latch of the present invention is very forgiving to fence component movement as can occur due to freeze—thaw cycles or post settling which render existing designs inoperative and in need of readjustment.

Having illustrated and described a preferred embodiment of the invention and certain possible modifications thereto, it should be apparent to those of ordinary skill in the art that the invention permits of further modification in arrangement and detail. The gate latch could be manufactured from other than flat metal bar provided the function is maintained. For example the round bar could be utilized or handle sections 2 and 3 use different configurations so long as pushing or pulling on the handles will cause the gate to open. The gate latch can also be adapted to work on doors for sheds, barns etc. All such modifications are covered by the scope of the invention.

The embodiments of the invention in which an exclusive property or privilege is claimed are defined as follows:

1. A gate latch for a fence gate or door having one side adapted to close against a fence post or door jamb on which a latch plate is mounted. said gate latch adapted to accommodate an in-swing or out swinging fence gate or door, said gate latch comprising a first handle portion and a second handle portion connected by a latch portion, wherein said latch portion is formed integral with said first handle portion, a mounting bracket and means to pivotally connect and bias die said latch portion to said mounting bracket wherein said gate latch wraps around said one side of said fence gate or door and wherein a first end of said first handle portion and the latch portion, when biased in the closed position, abuts said latch plate and directly prevented by said latch plate from allowing the fence gate or door to open; wherein either pushing or pulling on the said first or second handle portions causes said gate latch to pivot thereby moving said first end of the first handle portion and the latch portion clear of said latch plate permitting the fence gate or door to swing open.

2. A gate latch according to claim 1 wherein the first handle portion is a generally U-shaped flat bar member having an outer section, an interconnecting curved section and an inner section.

3. A gate latch according to claim 2 wherein the latch portion of said gate latch extends generally perpendicular and co-planar from a first end of said inner section of said first handle portion.

4. A gate latch according to claim 1 wherein the free end of said latch portion is adapted for pivotal connection to said mounting bracket.

5. A gate latch according to claim 4 wherein the free end of said latch portion is formed into a loop.

6. A gate latch according to claim 5 wherein said mounting bracket has a generally inverted L-shaped configuration with a top flat section and a vertically depending plate section with mounting holes provided in said plate section for attaching the bracket to said gate or door.

7. A gate latch according to claim 5 wherein said means to pivotally connect and bias the said latch portion to said mounting bracket comprises a bolt hole provided in the top flat section of said bracket wherein a shoulder bolt is placed through the bolt hole and the loop on the free end of latch portion and a spring having one end in a hole provided in the top section of said bracket, said spring encircles said bolt with a second end of said spring biasing the gate latch into the latched position.

8. A gate latch according to claim 2 wherein the said second handle portion comprises a first section having a first end connected to said latch portion adjacent said loop and a second end of said first section bent outwardly to form a handle section.

9. A gate latch according to claim 8 the first end of said first section of said second handle portion is welded to the said latch portion.

10. A gate latch according to claim 9 wherein a hole is provided in said first section of said second handle portion opposite the top hole in the plate section of said mounting bracket to permit a mounting screw to be inserted and wherein said first section is dimensioned so that the bottom hole in the plate section of said mounting bracket is accessible.

* * * * *